US006163025A

United States Patent [19]

Pantus

[11] Patent Number: 6,163,025

[45] Date of Patent: Dec. 19, 2000

[54] MOTION DETECTION SYSTEM

[75] Inventor: Mathias Maria Jozef Pantus, Brunssum, Netherlands

[73] Assignee: Aritech B.V.

[21] Appl. No.: 09/047,977

[22] Filed: Mar. 25, 1998

[30] Foreign Application Priority Data

Mar. 27, 1997 [NL] Netherlands ..... 1005660

[51] Int. Cl.[7] ..... G08B 13/191

[52] U.S. Cl. ..... 250/338.3; 250/353; 250/DIG. 1

[58] Field of Search ..... 250/338.3, DIG. 1, 250/353

[56] References Cited

U.S. PATENT DOCUMENTS

| | | | |
|---|---|---|---|
| 4,614,938 | 9/1986 | Weitman | 340/567 |
| 5,229,547 | 7/1993 | Murata et al. | 174/261 |
| 5,291,020 | 3/1994 | Lee | 250/342 |

FOREIGN PATENT DOCUMENTS

| | | |
|---|---|---|
| 0354451 | 1/1988 | European Pat. Off. . |
| 0633554 | 11/1995 | European Pat. Off. . |

*Primary Examiner*—Constantine Hannaher
*Assistant Examiner*—Otilia Gabor
*Attorney, Agent, or Firm*—Stoel Rivers LLP

[57] ABSTRACT

A detection system including motion detectors, which are built up and connected in such a manner that movement of an object through successive surveillance areas in one direction will result in the delivery of a first detector signal, which is different from a second detector signal, which will be delivered upon movement of said object through the surveillance areas in at least partially opposite direction. The trend of the detector signals furthermore includes a measure for the distance at which the object passes the detection system. When the structures for the motion detectors are provided on the substrate in a specific manner, it becomes possible to manufacture such motion detectors in a simple manner.

20 Claims, 9 Drawing Sheets

MOTION DETECTION SYSTEM

TECHNICAL FIELD

The present invention relates inter alia to a detection system comprising motion detectors, which each define a surveillance area, and which are arranged for responding to the movement of objects in the surveillance areas, which are at least partially separated from each other in space, by delivering respective detector signals.

The present invention also relates to a substrate for use in said detection system, to a pyro-electric infrared sensor comprising such a substrate, to a monitoring circuit comprising such a detection system, and to a method for generating detector signals upon movement of the object through the surveillance areas.

BACKGROUND OF THE INVENTION

A conventional detection system is known from EP-A-0 354 451. The known system uses pyro-electric sensors, which are connected in a manner which minimizes the risk of false alarm. The known detection system has a limited number of uses, however.

SUMMARY OF THE INVENTION

The object of the present invention is, therefore, to provide an improved detection system, which offers additional possibilities for providing direction-dependent information, that is, information about the direction in which the object is moving through the surveillance areas, while retaining the advantages of a minimal risk of false alarm.

In order to accomplish that objective the detection system according to the invention is characterized in that said motion detectors are connected in such a manner that movement of the object through successive surveillance areas in one direction will result in the delivery of a first detector signal, which is different from a second detector signal, which will be delivered upon movement of said object through the surveillance areas in at least partially opposite direction.

The advantage of the detection system according to the invention is that it has a wider range of application, since the present detection system is also capable of providing information with regard to the direction in which the object is moving through the surveillance areas. This wider range of application is expressed in particular when the detection system according to the invention is used in security systems, access control systems, alarm systems and the like. Not only can a security official establish directly, for example, that a room to be monitored is being undesirably visited, for example by an individual, but he can also establish directly in which direction said individual is moving, so that said individual can be stopped sooner than was previously the case.

Another advantage of the detection system according to the invention is that fact that it is possible to distinguish between different kinds of motion signals. Thus a distinction is made between motion-specific signals, which are generated by the movement of a human being, and non-motion-specific signals, which are generated as a result of air turbulence, incident light, mechanical shocks, etc. This distinction is sometimes indicated by the term "motion" signals, as opposed to "non-motion" signals. Said non-motion signals may result in false alarms, which have an adverse effect on the reliability of an alarm system. Such signals, which may also be generated as a result of irregularities that may occur in a detector or in the electronics of the detection system for that matter, must be avoided as much as possible. To that end, compensation provisions may be provided in the detection system. Such compensation provisions may also be used in this case, in so far as such provisions do not affect the motion-specific signalling aimed at by the invention. Where possible, such compensation facilities may be incorporated in the housing and/or the electronics of an alarm system according to the invention that is responsive to the direction of motion.

In one embodiment of the detection system, each of two detector signals is composed of more than one, in particular two, detection signals from series-connected motion detectors of opposed polarity.

The advantage of this embodiment of the detection system according to the invention is that it easily bears severe tests, such as for example the light test (standard reference "White Light IEC 839-2-6"), wherein bright white light is sent alternately for two seconds to the detection system and subsequently turned off for two seconds. In addition to this "common mode" suppression, the series-connection also makes the detection system according to the invention largely insensitive to disturbances or shocks which may occur simultaneously or separately in the substrate in question, irrespective of the polarity thereof.

In one possible embodiment of the substrate for use in the detection system said substrate is made of a pyro-electric material, wherein the substrate has two flat sides, and wherein four first connecting parts having polarities −, +, +, and − respectively of four motion detectors provided in parallel relationship on the substrate are present on the first flat side, with the four corresponding second connecting parts having polarities +, −, −, and + respectively being present on the second flat side, opposite said four first connecting parts, wherein the first connecting parts of the first and the third motion detectors and those of the second and the fourth motion detectors are electrically interconnected, wherein the second connecting parts of the second and the third motion detectors are electrically interconnected, and wherein the second connecting parts of the first and the fourth motion detectors are intended for respectively receiving each of the detector signals.

The advantage of the substrate according to the invention is that is it capable of performing exactly the required additional function of providing direction-dependent information, whilst it can furthermore be produced in a simple manner by means of processes which are known per se. As a matter of fact this additional function not only applies to those cases where a warm object is moving in a cold environment, but also to cases where a cold object is moving through a warm environment.

In addition to this, it is advantageous that the substrate does not comprise a connecting wire on the front side, thus avoiding the drawbacks of the presence of such a connecting wire, such as the occurrence of thermal disturbances on said front side and a reduction of the detection area.

In one method according to the invention, which significantly widens the range of application, a measure which provides information about the distance at which an object is moving is derived from one of the detector signals or from a combination of the detector signals. To that end, the respective detection system according to the invention comprises the means for deriving said measure from the development of one of the detector signals or a combination thereof. In this manner, the detection system also obtains location-direction of movement characteristics, which transcend the single presence characteristics of the known system.

The invention and its further concomitant advantages will now be explained in more detail with reference to the appended drawings, wherein corresponding parts are indicated by corresponding numerals in the figures.

BRIEF DESCRIPTION OF THE DRAWINGS

FIGS. 1 and 2 are superimposed, a total image of the electrically conductive structures which are provided on either flat side of the substrate is created.

DETAILED DESCRIPTION OF PREFERRED EMBODIMENTS

Figure 1:
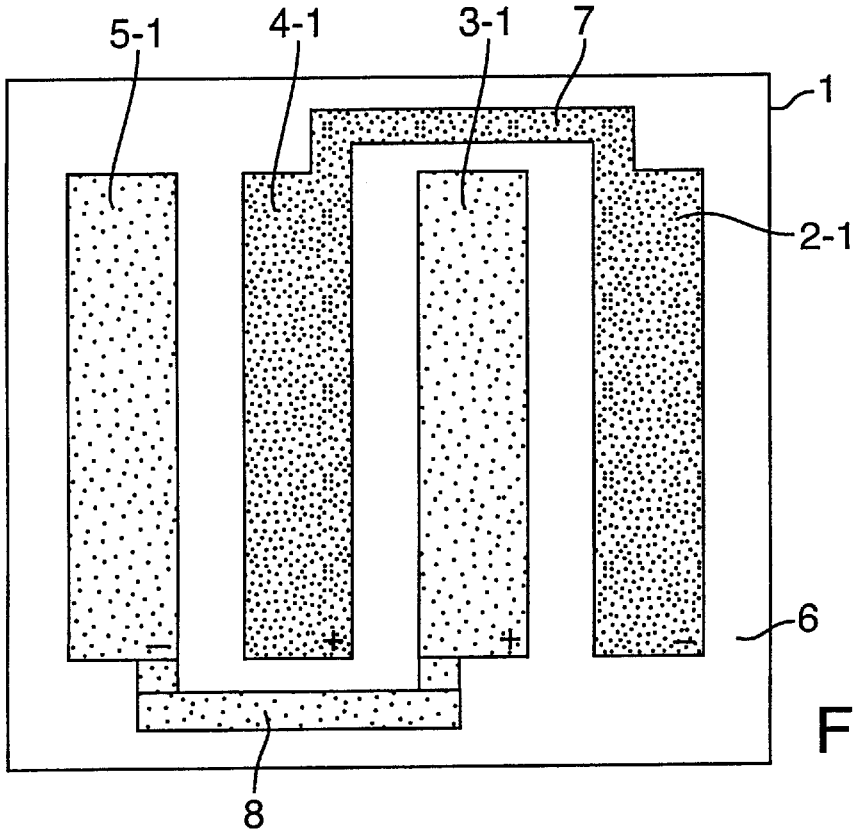
FIG. 1 shows the electrically conductive structure on the front side of motion detectors provided on a common substrate.

FIG. 1 shows a substrate 1, which is made of a pyro-electric material, and which constitutes the common carrier for four electrically conductive structures or paths 2-1, 3-1, 4-1, and 5-1 having polarities –, +, +, and – respectively, which are provided on the illustrated flat front side of substrate 1. Provided on the first flat side 6 of substrate 1 is a further connection 7 between electrically conductive structures 2-1 and 4-1, together with yet another electrically conductive structure 8, which interconnects structures 5-1 and 3-1.

Figure 2:
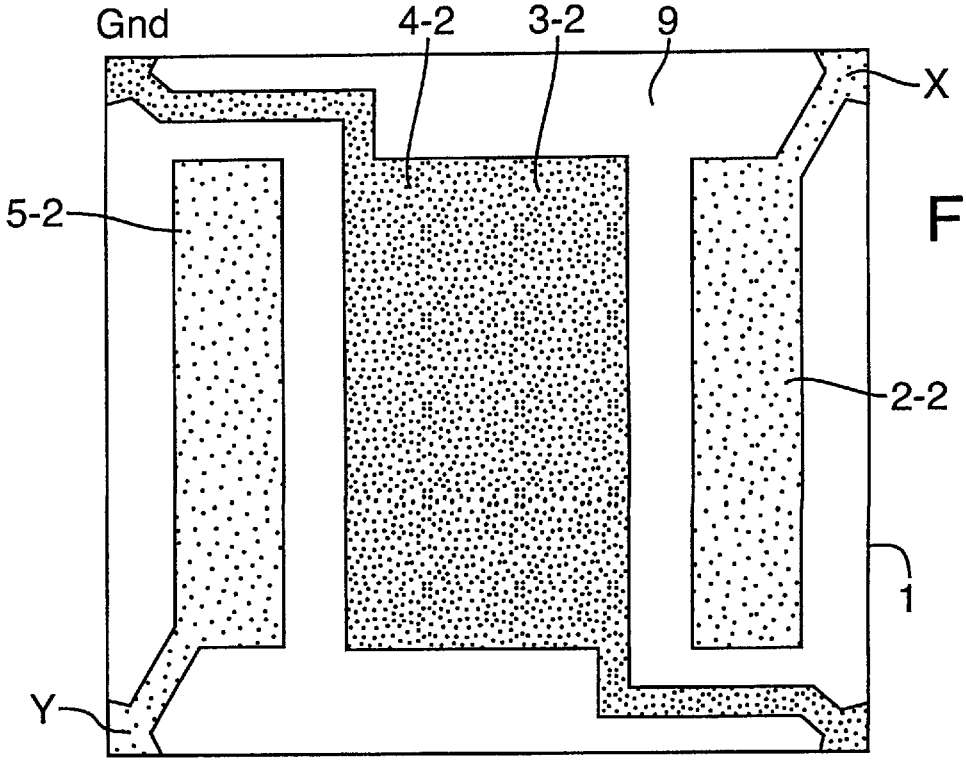
FIG. 2 shows the other side of said substrate, seen from the same front side as shown in FIG. 1, so that when

FIG. 2 shows the other flat side 9 of substrate 1. Paths, patterns, or structures 2-2, 3-2, 4-2, and 5-2 are provided on said side. Structure 2-2 shows the other flat side of substrate 1. On this side, paths, patterns, or structures 2-2, 3-2, 4-2, and 5-2 are provided. Structure 2-2 terminates in terminal X, whilst structure 5-2 terminates in terminal Y. Structures 4-2 and 3-2 are continuous and are interconnected so as to form a reference potential, for example ground (Gnd). The configuration of the aggregate of the structures is such that in the assembled condition of the motion detectors neither the connections to ground on the one hand nor the connections 7 and 8 on the other hand have any corresponding electrically conductive structures on the respective opposite flat sides. This is clearly demonstrated when the structures of FIGS. 1 and 2 are superimposed. Thus the detector signals only originate from each of the four motion detectors 2, 3, 4, and 5, which are configured as operative capacitors. The capacitors change when the pyro-electric material is exposed to IR radiation, as a result of which the detector signals will be generated.

Figure 4:
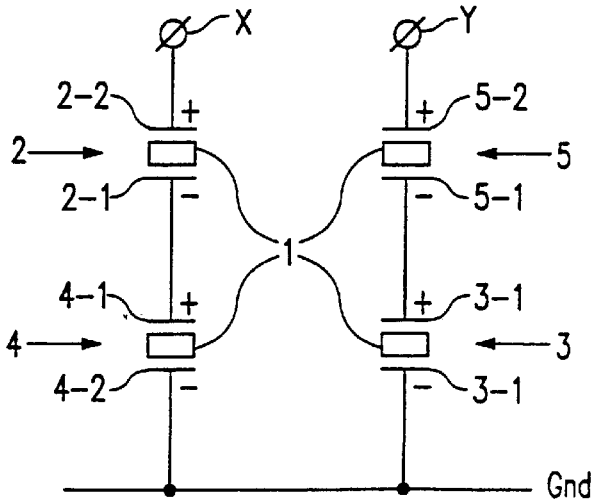
FIG. 4 shows the electric diagram of the connection of the motion detectors of FIGS. 1 and 2.

The principle diagram of the successive interconnected motion detectors 2, 3, 4, and 5 is shown in FIG. 4.

Figure 3:
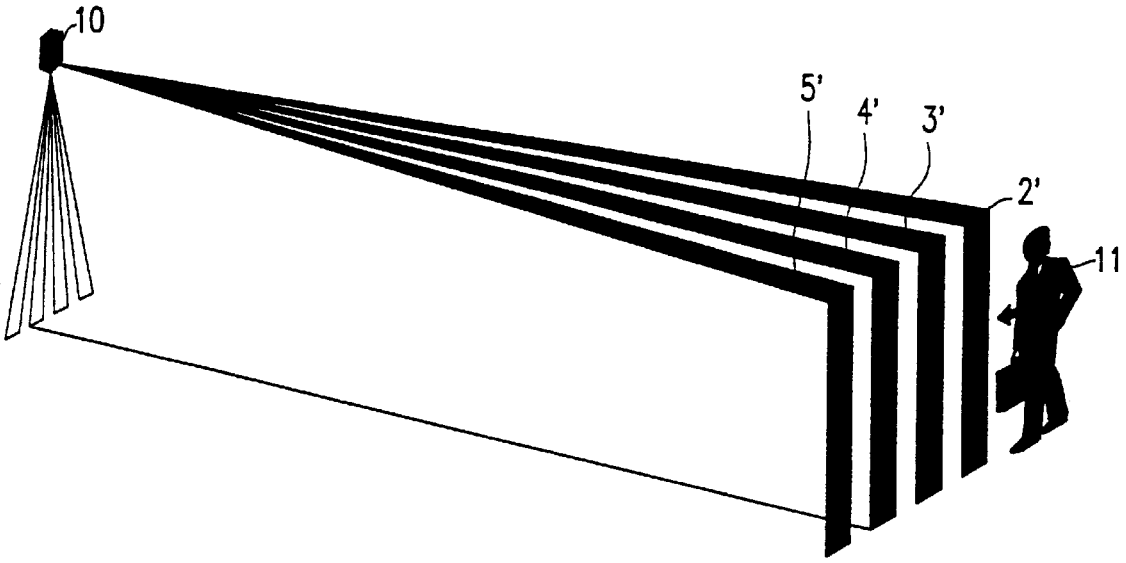
FIG. 3 is a diagrammatic representation of the successive surveillance areas, which can be defined by the motion detectors shown in FIGS. 1 and 2.

FIG. 3 shows a detection system 10, which may be mounted inside a room or outside on a building, for example, and which is provided with a pyro-electric sensor, for example an infrared sensor, which is in turn provided with the above-explained motion detectors 2, 3, 4, and 5. A focussing element is placed in front of the flat side 6 of substrate 1 in a manner which is known per se, as a result of which motion detectors 2, 3, 4, and 5 define four surveillance areas in this case, namely 2', 3', 4', and 5' respectively. When an object 11 moves through the aforesaid areas in the direction indicated by the arrow, that is, from the right to the left, the crossing of area 2' will be detected by motion detector 2, setting aside for the time being a possible reversing effect caused by the possible use of a focussing mirror. As a result of the presence of structure 2-1, which has a negative charge or polarity, an initially negative going detector signal X (shown in the left-hand part of FIG. 5) will develop, followed about a quarter period later by a positive going detector signal Y, which is generated as a result of the crossing of surveillance area 3'. Due to the fact that the polarity of structure 4-1 is positive, the crossing of area 4' contiguously thereto leads to detector signal X becoming positive, because structure 2-1 will be exposed less in that case, if at all. The crossing of surveillance area 5' contiguously thereto leads to detector signal Y becoming negative, whereby surveillance 3' will no longer be crossed. Thus a negative sine-shaped detector signal X, which is shown in the left-hand part of FIG. 5, and a negative cosine-shaped detector signal Y can be recognized when the respective surveillance areas 2', 3', 4', and 5' are being crossed from the right to the left. In other words, when detector signal X is plotted along a horizontal axis and detector signal Y is plotted along a vertical axis, as shown in FIG. 6, a clockwise Lissajous representation is formed when the successive surveillance areas 2', 3', 4', and 5' are crossed from the right to the left.

Figure 5:
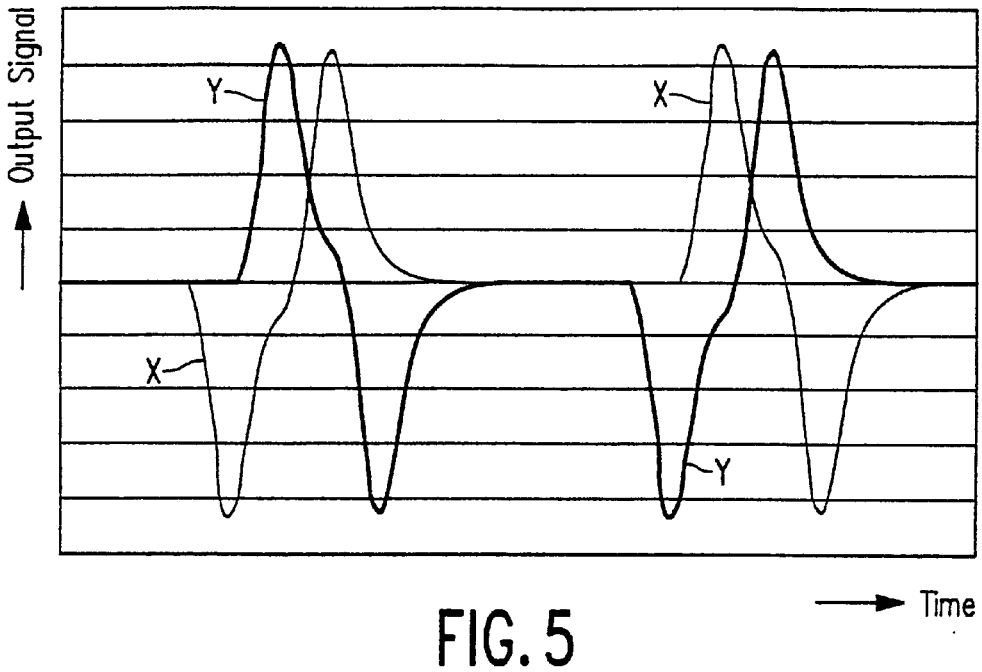
FIGS. 5, 7, and 9 show the trend of X and Y-signals as a function of time, whilst
Figure 6:
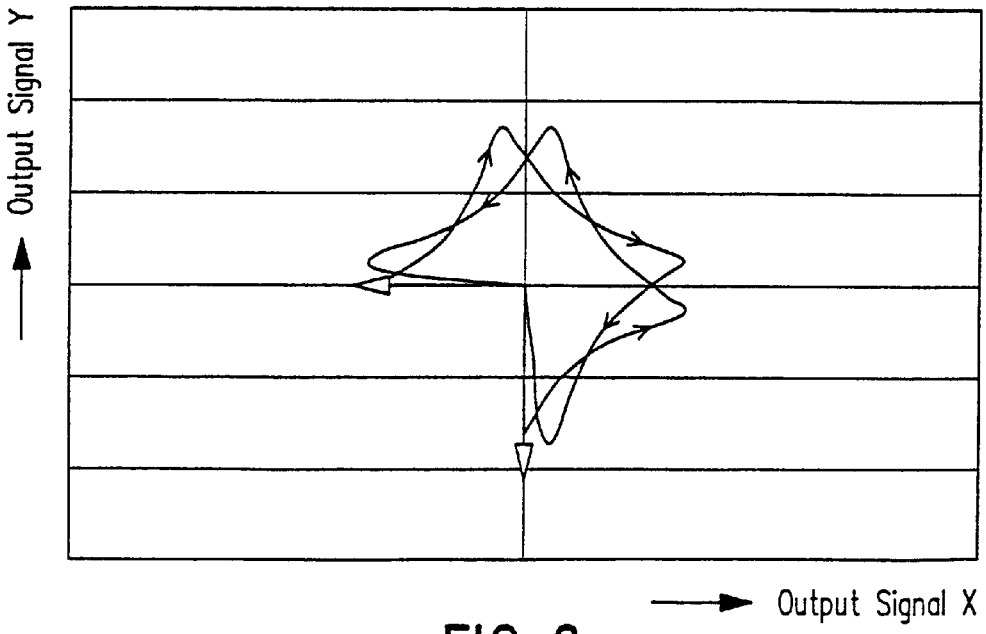
FIGS. 6, 8 and 10 show the associated course of the Lissajous representations of said signals at 150%, 100% and 70% respectively of an optimum reach.

Conversely, that is, when the surveillance areas are crossed from the left to the right, the detector signals X and Y shown in the right-hand part of FIG. 5 will be negative cosine-shaped and negative sine-shaped respectively, and an anti-clockwise combination of detector signals X and Y as shown in FIG. 6 is formed. With the aid of very simple detection means, it can be established whether a clockwise or anti-clockwise Lissajous representation is concerned, so that in addition to the fact that an object is detected crossing the surveillance areas, it can be concluded in which direction said object is moving. Generally the phase relation:

$$\varnothing = \arctan(Y/X)$$

with a substantially constant signal $$d = \sqrt{(X^2 + Y^2)}$$

can be measured with the aid of very simple means, and from the trend of the phase relation it can be derived, therefore, in which direction someone is passing the detector system.

Figure 7:
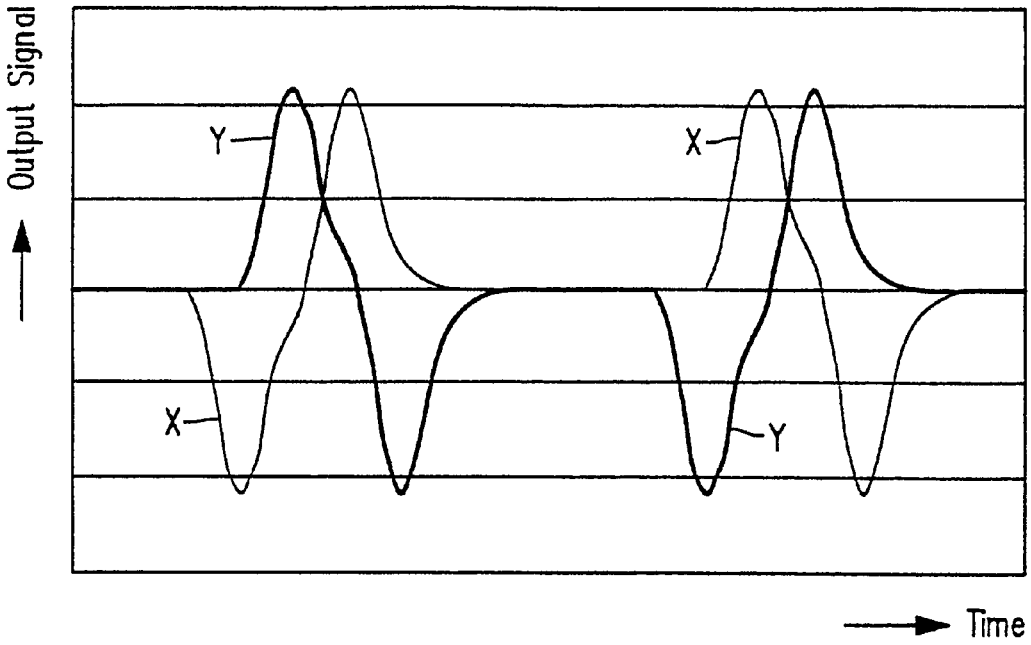
Figure 8:
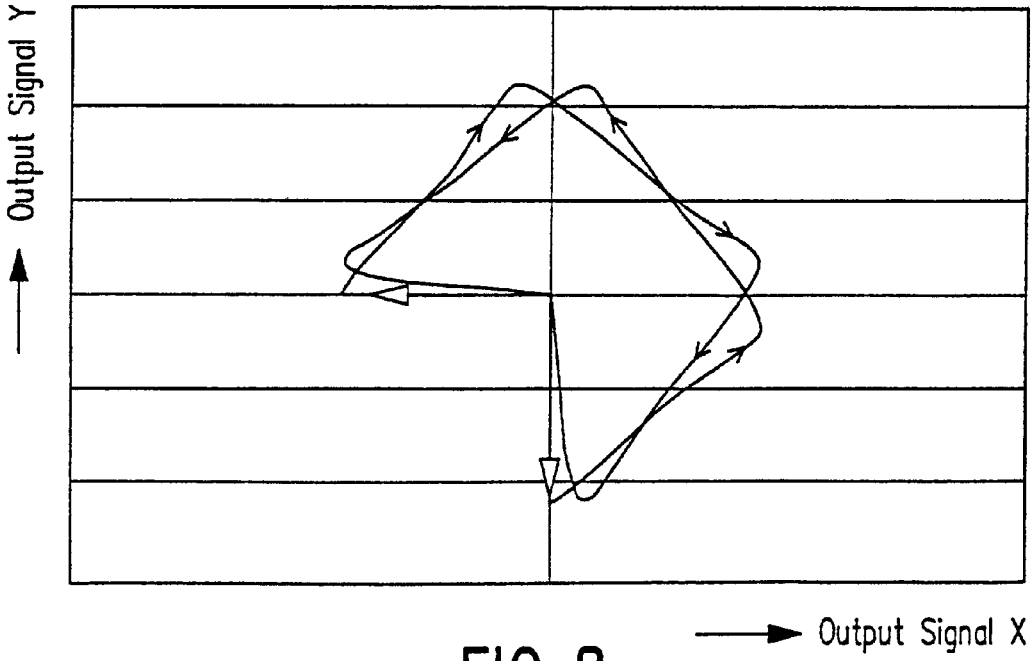
Figure 9:
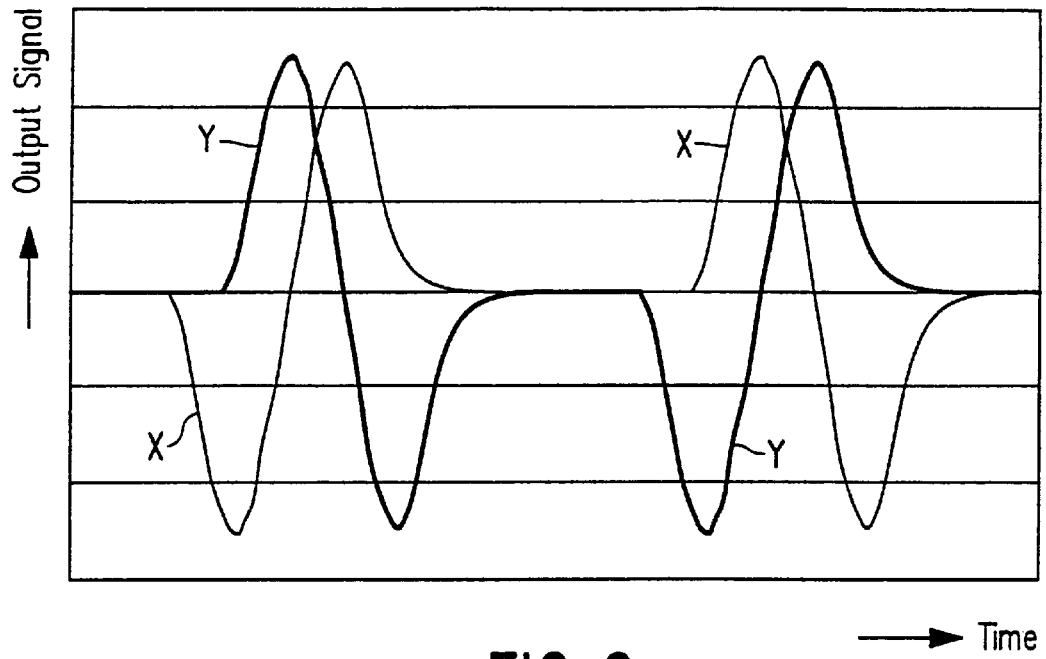
Figure 10:
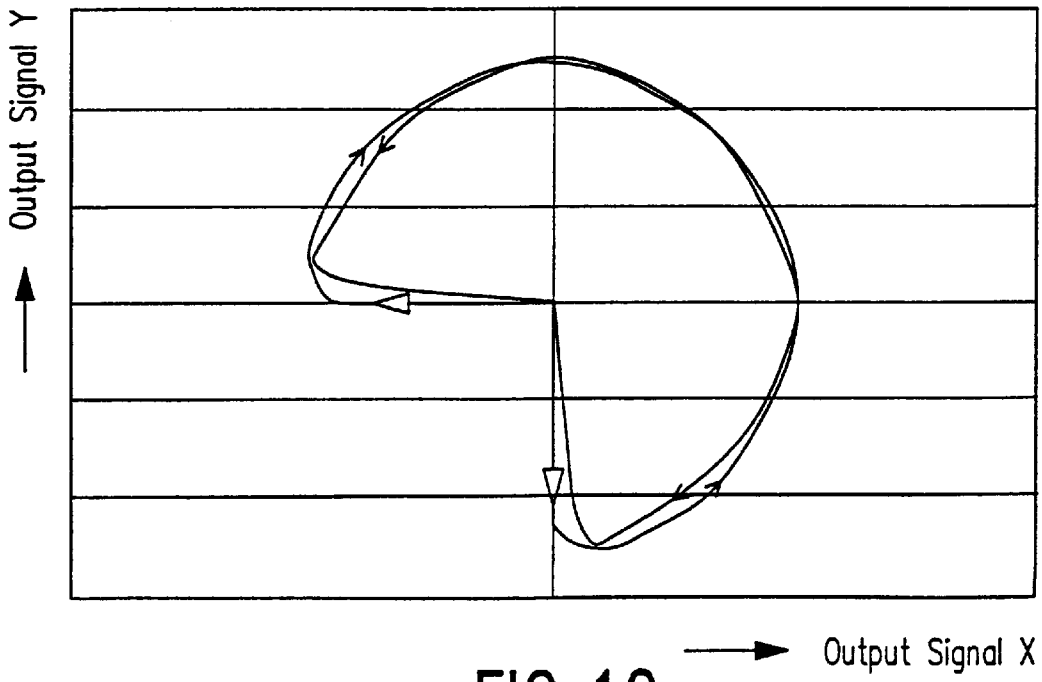
Figure 11:
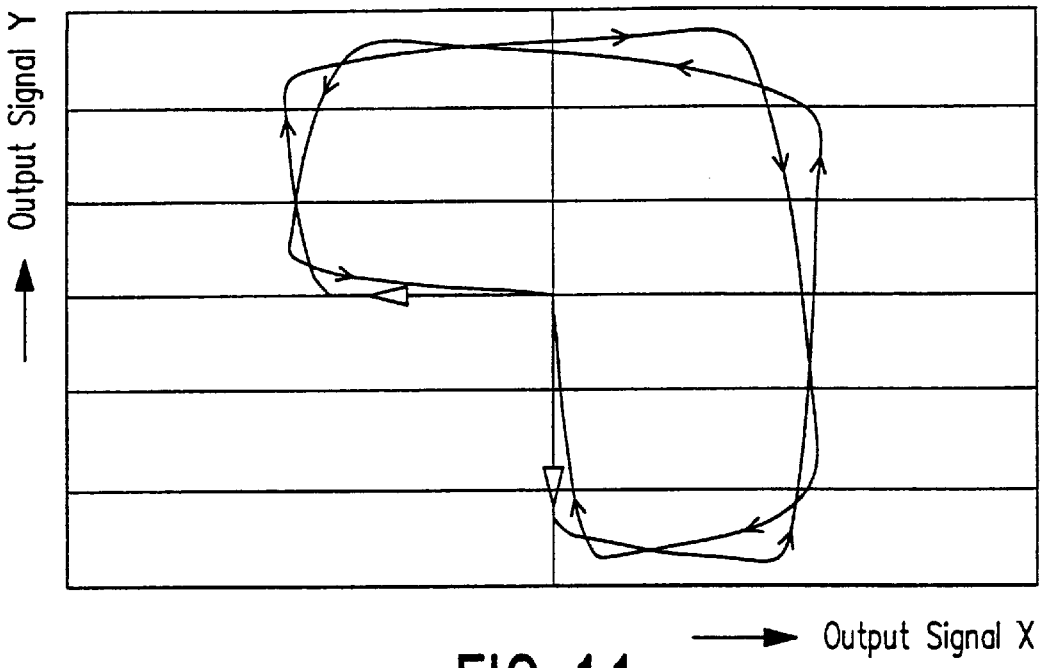
FIGS. 11 and 12 show the course of Lissajous representations of the X and Y-signals at about 45% and 25% respectively of the optimum reach.
Figure 12:
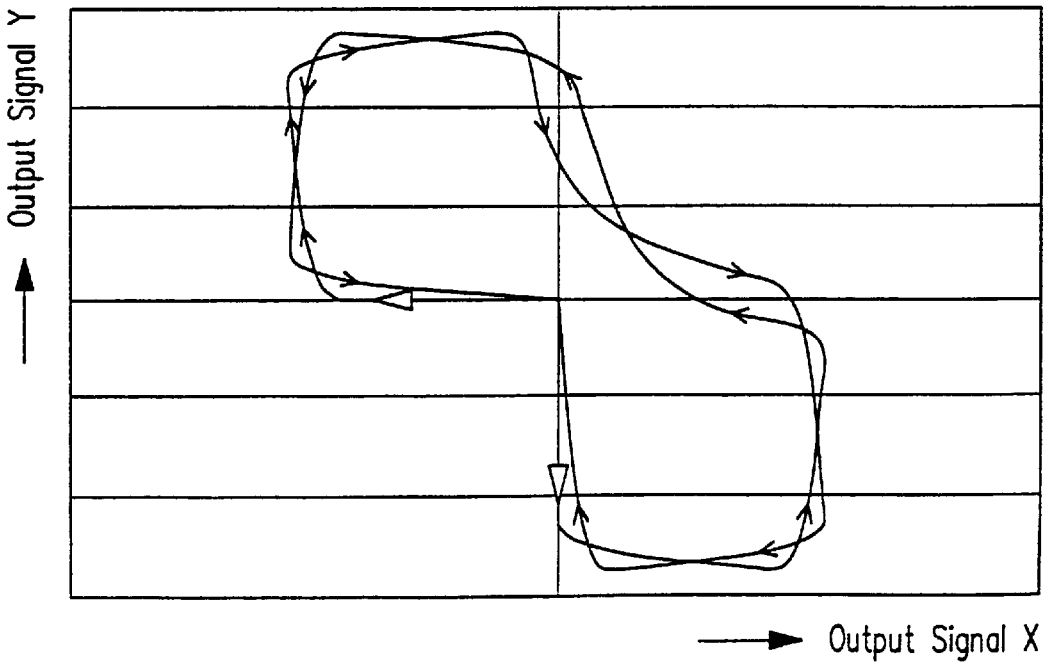

The configuration of the various individual surveillance areas as shown in FIG. 3 can be realized by using a combination of the pyro-electric motion detectors 2–5 and mirror optics (not shown) having a particular gap width, which determines the width of the surveillance areas 2'–5' at the distance at which the moving object 11 is passing. Thus FIGS. 7 and 8 show graphs similar to the ones shown in FIGS. 5 and 6 of signals which are generated when a slightly larger gap width is used. The width of surveillance areas 2'–5' will also be slightly greater when the latter gap width is used, therefore. An even larger gap width about twice as large as in the former case will result in the graphs shown in FIGS. 9 and 10.

Imagine that in the case of FIGS. 7 and 8, mirror optics have been selected wherein the width of each surveillance area 2', 3', 4', and 5', for example at a distance of 15 meters from detection system 10, is 28 cm, which falls within the tolerance of, say, 25% of the average width of a person. When this person passes the detection system at about 7 m from the detection system, a signal will be delivered which corresponds with the graphs in FIGS. 9 and 10 as regards its shape. In other words, the degree to which the Lissajous representations exhibit a round and smooth trend constitutes a measure for the distance at which someone is passing the detector system. Surprisingly, the graphs thus include a measure for the distance at which the person, whose direction of movement could be established already, passes detection system 10. Said measure will usually include the more or less tapered form, the area and/or the trend of the circumference of one or more graphs from FIGS. 5–10, 11, and 12.

With an optimum reach of for example 10 m, FIGS. 6, 8, 10, 11, and 12 thus show the Lissajous representations of the X and Y-signals at 15 m, 10 m, 7 m, 4.5 m, and 2.5 m respectively from the detector system.

Figure 13:
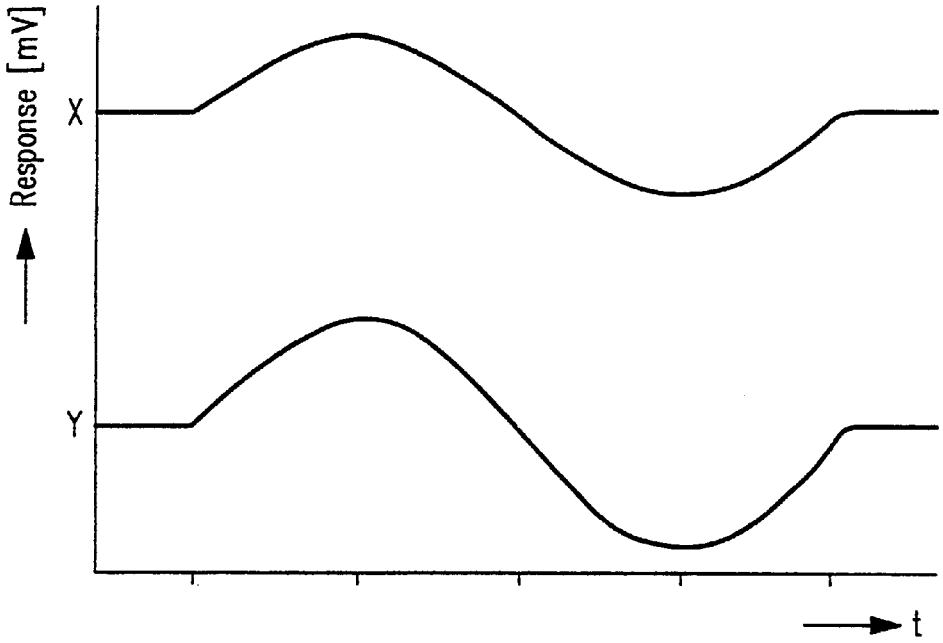
FIG. 13 shows the course of the X and Y-signals as a function of time, which has been obtained by means of an IEC 839-2-6 light test.

FIG. 13 shows the effects of the aforesaid white light test on the X and Y-signals. During this test bright white light is turned on for 2 seconds and subsequently turned off again for 2 seconds. The changes in these signals occur simultaneously, and furthermore have the same polarity, so that the result of these non-motion-specific signals through the series-connected motion detectors of opposed polarity is that no false alarm will be given.

Figure 14:
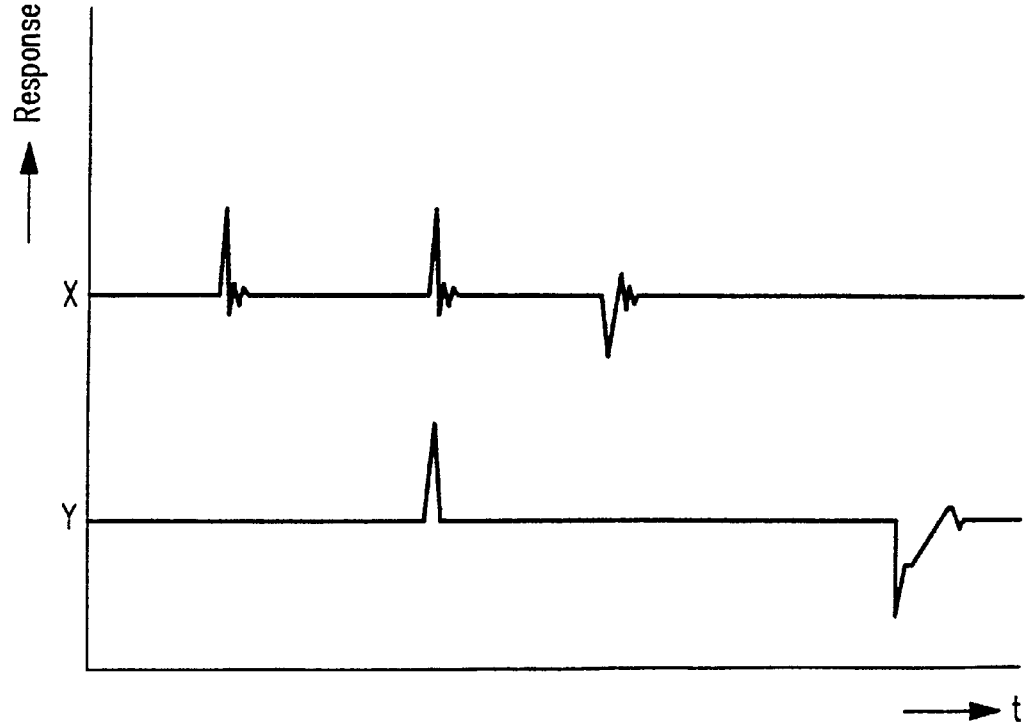
FIG. 14 shows the effect on the X and Y-signals of mechanical shock signals that may occur.

FIG. 14 shows the effect of a different type of non-motion-specific signal, namely mechanical shocks. Only the X-signal or the Y-signal will become positive or negative, or both will get the same polarity, so that also this type of signals will not lead to a false alarm.

In practice a detection system has been developed wherein four detectors, each measuring 3×0.7 mm, are provided on a substrate on an active area of 8.4 $mm^2$ in total. The net effect is a doubling of the signal-noise ratio. Moreover, the dimension of a detector is optimally geared and adapted to the elongated contours of a human being, which makes it easier to detect such a human being.

Autocorrelation of signals X and Y leads to a further improvement of 3 db, which, when combined with the RMS method, will eventually lead to a noise reduction of 9 db for such a small detector.

Figure 15:
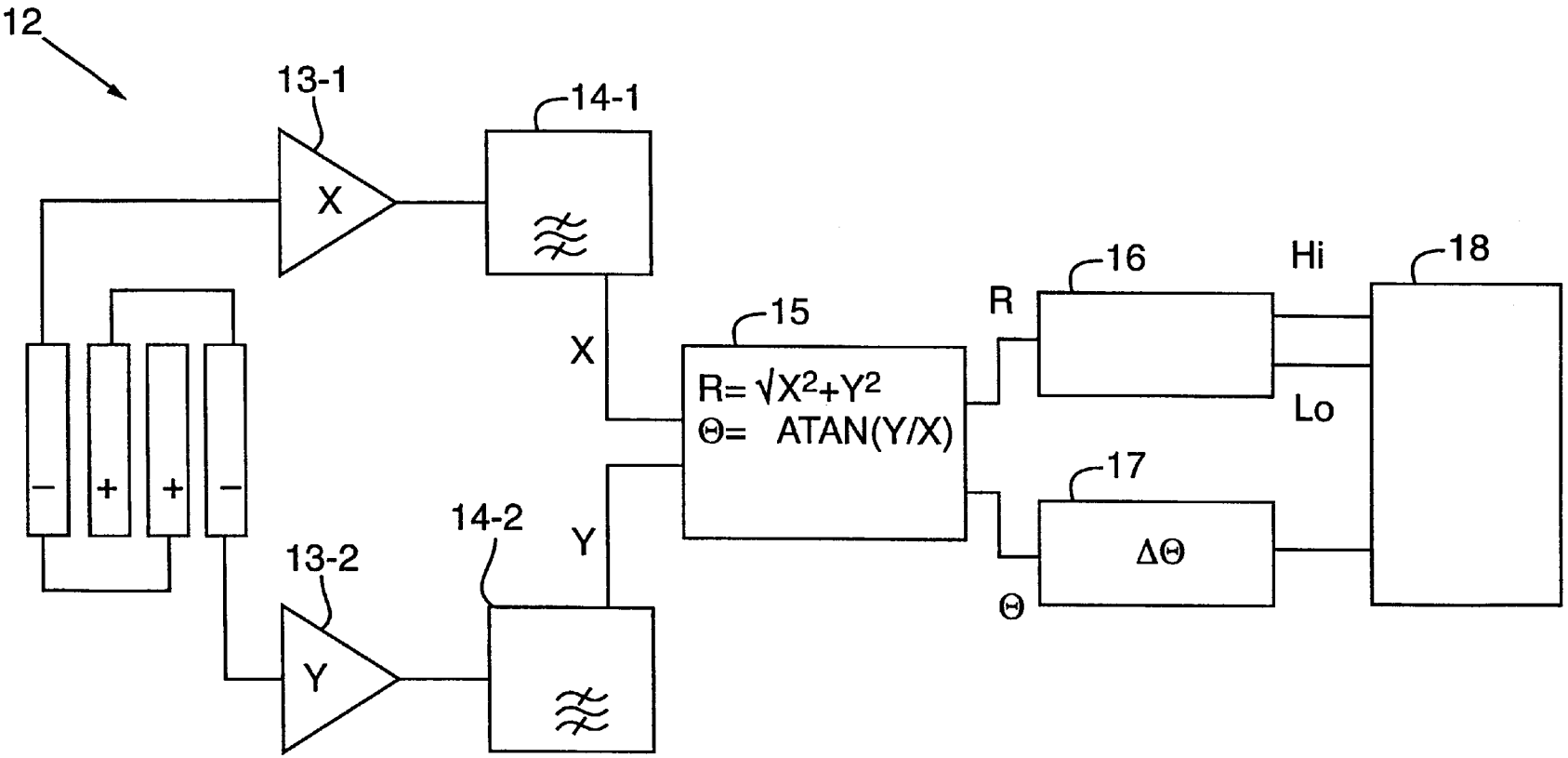
FIG. 15 shows a possible embodiment of a monitoring circuit according to the invention, which includes the motion detectors shown in FIGS. 1 and 2.

FIG. 15 diagrammatically shows a possible embodiment of a monitoring circuit 12. Monitoring circuit 12 includes two amplifiers 13-1 and 13-2 and associated bandpass filters 14-1 and 14-2, which are each connected to the X and Y terminals shown in FIG. 2. Bandpass filters 14-1 and 14-2 are connected to means 15 which determine the polar coordinate, in which the phase relation θ and the signal size or radius R are calculated in accordance with the two above relations. Radius R is fed to a threshold device 16 in order to determine whether R is larger or smaller than an upper limit Hi or a lower limit Lo respectively, whilst the phase relation θ is fed to a difference device 17 in order to obtain information with regard to the phase shift. Both the radius shift and the phase shift are fed to a processing unit 18, which will generally include alarm means for producing an alarm signal if the radius shift and/or the phase shift warrant this.

Figure 16:
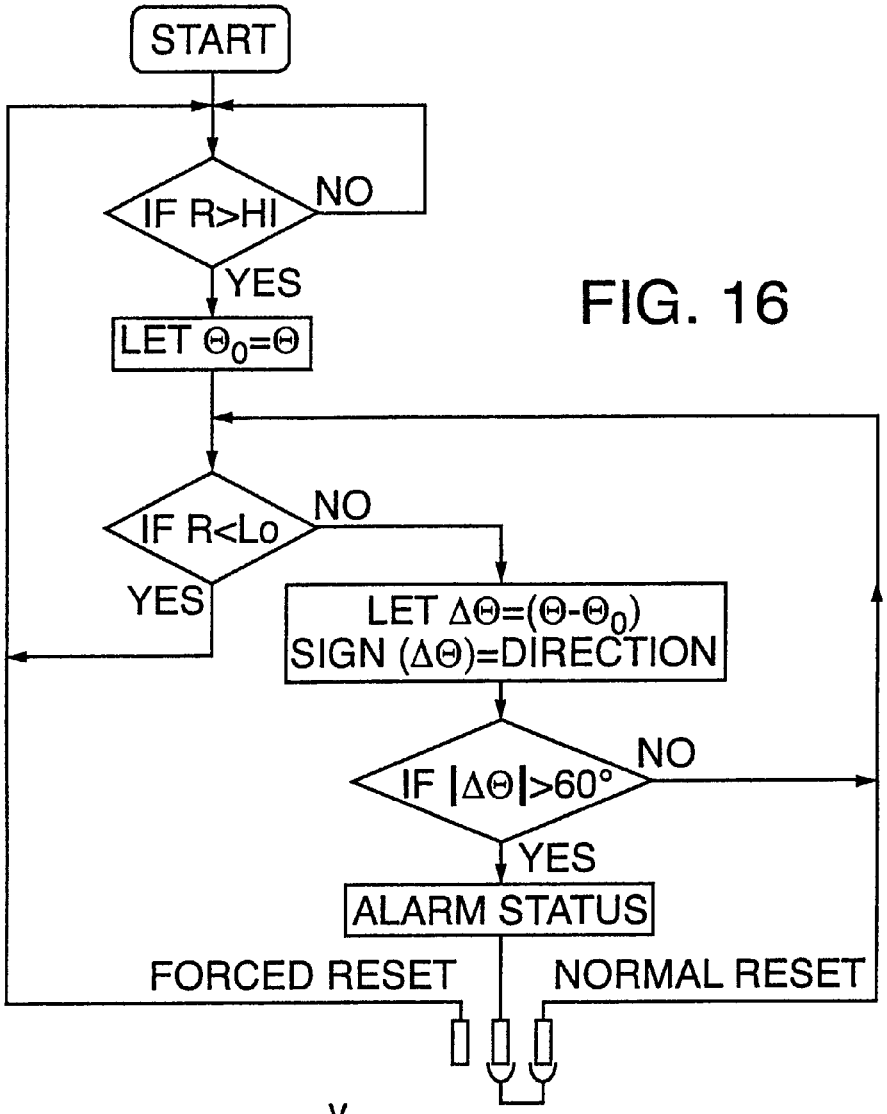
FIG. 16 is a flow diagram of a monitoring algorithm to be implemented, wherein the circuit shown in FIG. 15 is used.
Figure 17:
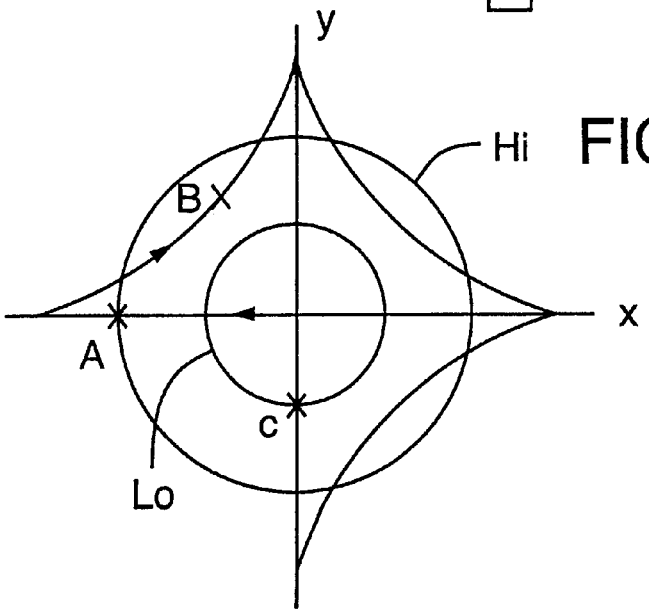
FIG. 17 is a polar figure, by means of which the monitoring algorithm will be explained in more detail.

FIG. 16 is a flow diagram of a monitoring algorithm which may be implemented in processing unit 18, wherein use is made of monitoring circuit 12. After starting, the current value of θ will be only stored as $\theta_0$ if signal Hi indicates that R>Hi. If subsequently it does not apply that R<Lo, with Lo being above the noise threshold, a phase difference $\Delta\theta=\theta-\theta_0$ is determined, and the symbol of phase difference Δθ is determined. Only if the absolute value of phase difference Δθ becomes larger than a phase decision value of 60 degrees, for example, an alarm signal will be generated. In polar FIG. 17, in which a person walks from the left to the right past the sensor, the alarm is raised at point B after point A has been passed, after which the alarm is reset via point C. It is possible to influence the situation in which the alarm is generated by varying the threshold values Hi and Lo, and the aforesaid phase decision value. Thus, an increase of Hi will cause the maximum detection distance to decrease, whilst no detection will take place anymore in the case of an increase of Lo—which occurs when a person walks in a hesitant manner (FIG. 17).

It will be obvious to those having skill in the art that many changes may be made to the details of the above-described embodiments of this invention without departing from the underlying principles thereof. The scope of the present invention should, therefore, be determined only by the following claims.

What is claimed is:

1. A detection system comprising motion detectors, which each define a surveillance area, and which are arranged for responding to the movement of objects in the surveillance areas, which are at least partially separated from each other in space, by delivering respective detector signals, characterized in that said motion detectors are connected in such a manner that movement of the object through successive surveillance areas in one direction will result in the delivery of different first and second signals that together form a quadrature signal that corresponds to the motion of the object as it moves through the successive surveillance areas.

2. A detection system according to claim 1, wherein said first and said second detector signals exhibit a substantially similar course as a function of time.

3. A detection system according to claim 2, wherein said first and said second detector signals are phase-shifted relative to each other.

4. A detection system according to claim 1, wherein said first and said second detector signals are phase-shifted relative to each other.

5. A detection system according to claim 4, wherein said motion detectors are built up of substantially identical, electrically conductive connecting parts extending in longitudinal direction, which are provided in parallel relationship on a common substrate made of pyro-electric material.

6. A detection system according to claim 1, wherein each of the two detector signals is composed of more than one, in particular two, detector signals from series-connected motion detectors of opposed polarity.

7. A detection system according to claim 6, wherein said motion detectors are built up of substantially identical, electrically conductive connecting parts extending in longitudinal direction, which are provided in parallel relationship on a common substrate made of pyro-electric material.

8. A detection system according to claim 1, wherein said motion detectors are built up of substantially identical, electrically conductive connecting parts extending in longitudinal direction, which are provided in parallel relationship on a common substrate made of pyro-electric material.

9. A detection system according to claim 8, wherein said common substrate has two flat sides, and wherein four first connecting parts of four motion detectors are present on the substrate, with the four corresponding second connecting parts being present on the second flat side, opposite said four first connecting parts.

10. A detection system according to claim 9, wherein the first connection parts of the first and the third motion detector and those of the second and the fourth motion detector are electrically interconnected, wherein the second connection parts of the second and the third motion detector are electrically interconnected, and wherein the second connection parts of the first and the fourth motion detector are intended for respectively receiving each of the detector signals.

11. A detection system according to claim 1, wherein said detection system comprises means which provide an indication as to the course of one of the detector signals and/or a combination of said detector signals.

12. A substrate provided with motion detectors for use in the detection system according to claim 1, which substrate, which is made of a pyro-electric material, has two flat sides, wherein four first connecting parts having polarities –, +, +, and – respectively of four motion detectors provided in parallel relationship on the substrate are present on the first flat side, with the four corresponding second connecting parts having polarities +, –, –, and + respectively being present on the second flat side, opposite said four first connecting parts, wherein the first connecting parts of the first and the third motion detector and those of the second and the fourth motion detector are electrically interconnected, wherein the second connecting parts of the second and the third motion detector are electrically interconnected, and wherein the second connecting parts of the first and the fourth motion detector are intended for respectively receiving each of the detector signals.

13. A pyro-electric infrared sensor provided with one or more substrates according to claim 12.

14. An access control system comprising a detection system according to claim 1.

15. A monitoring circuit comprising a detection system according to claim 1, characterized in that the monitoring circuit furthermore comprises:

means determining the polar coordinate, which are connected to the respective second connecting parts of the first and the fourth motion detectors of the detection system, and alarm means connected to the means determining the polar coordinate, which function to generate an alarm in dependence on the current value(s) and/or the shift of the polar coordinates as a function of time.

16. A method for generating detector signals upon movement of an object through areas to be monitored, wherein the movement of the object through the areas generates different first and second signals that together form a quadrature signal that corresponds to the motion of the object.

17. A method according to claim 16, wherein different detector signals are generated when the object moves in opposite directions through said areas.

18. A method according to claim 16, wherein phase-shifted detector signals are generated when the object moves in different directions through said areas.

19. A method according to claim 16, wherein phase-shifted detector signals are generated when the object moves in opposite directions through said areas.

20. A method according to claim 16, wherein a measure which provides information about the distance at which an object is moving is derived from one of the detector signals or from a combination of the detector signals.

* * * * *